US007832830B2

(12) United States Patent
Kojima

(10) Patent No.: US 7,832,830 B2
(45) Date of Patent: Nov. 16, 2010

(54) INKJET RECORDING DEVICE

(75) Inventor: Takashi Kojima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 300 days.

(21) Appl. No.: 12/056,182

(22) Filed: Mar. 26, 2008

(65) Prior Publication Data

US 2008/0238987 A1 Oct. 2, 2008

(30) Foreign Application Priority Data

Mar. 29, 2007 (JP) ..... 2007-089162

(51) Int. Cl.
*B41J 2/165* (2006.01)

(52) U.S. Cl. ..... 347/29; 347/22

(58) Field of Classification Search ..... 347/29, 347/22, 32, 33
See application file for complete search history.

(56) References Cited

U.S. PATENT DOCUMENTS 5,483,267 A 1/1996 Nemura et al.
6,866,361 B2 3/2005 Kuki et al.

FOREIGN PATENT DOCUMENTS

| | | | |
|---|---|---|---|
| EP | 1405725 | A1 | 4/2004 |
| EP | 1600296 | A1 | 11/2005 |
| JP | H06-000692 | A | 1/1994 |
| JP | 2003-312028 | A | 11/2003 |
| JP | 2004142450 | A | 5/2004 |

OTHER PUBLICATIONS

Japan Patent Office; Notice of Reasons for Refusal in Japanese Patent Application No. 2007-089162 (counterpart to the above-captioned U.S. Patent Application) mailed Jan. 27, 2009. (partial translation).
European Patent Office, European Search Report for Related EP Application No. 08005822 dated Aug. 27, 2008.

*Primary Examiner*—Lamson D Nguyen
(74) *Attorney, Agent, or Firm*—Baker Botts L.L.P.

(57) ABSTRACT

An inkjet recording device one aspect of the invention comprises: a plurality of inkjet heads each having an ink ejection surface; a frame that has a plurality of holes formed therein and supports the plurality of inkjet heads such that the plurality of ink ejection surfaces are respectively exposed from the plurality of holes; a cap comprising a projection formed thereon to define a plurality of recessed portions; and a cap moving mechanism configured to move at least one of the cap and the frame to selectively position the projection at a first position and a second position. The projection at the first position abuts on the frame such that the plurality of ink ejection surfaces are respectively surrounded by the plurality of recessed portions. The projection at the second position is spaced from the frame.

5 Claims, 7 Drawing Sheets

INKJET RECORDING DEVICE

CROSS-REFERENCE TO RELATED APPLICATIONS

This application is based upon and claims the benefit of priority from Japanese Patent Application No. 2007-089162, filed on Mar. 29, 2007, the entire contents of which are incorporated herein by reference.

TECHNICAL FIELD

The present invention relates to a inkjet recording device including a plurality of inkjet heads configured to eject ink drops.

BACKGROUND

JP-A-2004-142450 discloses a color inkjet recording device including four inkjet heads and a maintenance unit configured to perform a maintenance operation on the four inkjet heads. In this color inkjet recording device, the maintenance unit has a cap made of an elastic material such as rubber for covering nozzle surfaces of the inkjet heads and a blade (a wiper) for wiping off ink which adheres to the nozzle surfaces of the inkjet heads. In addition, the nozzle surfaces of the inkjet heads are covered by the cap when the maintenance unit is in a purge position. At this time, a purge operation is performed on the inkjet heads. Thereafter, when the maintenance unit moves from the purge position to a retracted position, the blade wipes the nozzle surfaces, whereby ink adhering to the nozzle surfaces is removed. In addition, when the inkjet recording device is on standby, the cap covers the nozzle surfaces to thereby prevent inks in nozzles from being dried.

SUMMARY

According to the inkjet recording device described in JP-A-2004-142450, a projection is formed on the cap to define recessed portions, and the projection formed on the cap contacts with the nozzle surfaces so that the nozzle surfaces of the inkjet heads are covered by the recessed portions on the cap. When the projection on the cap abuts on the nozzle surfaces, there may be caused a case where a chemical reaction occurs between inks remaining on the nozzle surfaces and the elastic material of the cap so as to produce a deposit. In addition, there may also be caused a case where dust which scatters around inks staying in a boundary between the projection on the cap and the nozzle surfaces comes to adhere to the inks so staying to produce a material which sticks thereto. Due to this, even when the cap is spaced apart from the nozzle surfaces, impurities made up of deposits and sticking materials adhere to areas on the nozzle surfaces on which the projection of the cap abuts. At this time, when the blade wipes the whole areas of the nozzle surfaces, the impurities adhering to the nozzle surfaces are spread over the entirety of nozzle surfaces, whereby the impurities are caused to adhere to the peripheries of the openings (ejection ports) of the nozzles to thereby deteriorate the repellency of the nozzle surfaces or intrude into the nozzles to clog them up. In this case, the ink ejection properties are worsened.

Then, it is considered that the projection which define the recessed portions abuts on an outer perimeter or frame of the frame which supports the four inkjet heads. At this time, the recessed portions on the cap are made to cover the nozzle surfaces of the four inkjet heads all together. By this configuration, since the projection on the cab does not abuts on the nozzle surfaces, no impurity is caused to adhere to the nozzle surfaces in any case. However, when the ejection ports are purged of inks in such a state that the recessed portions on the cap cover the nozzle surfaces of the four inkjet heads, there may be caused a case where inks so ejected scatter within the recessed portions to adhere to the nozzle ejection surfaces of the other inkjet heads, whereby the plurality of kinds of inks are mixed with each other at the nozzle surfaces. In this case, the recording quality is deteriorated.

Then, the invention has been made in view of these situations and an object thereof is to provide a color inkjet recording device which can suppress the adhesion of impurities to ink ejection surfaces without deteriorating the recording quality thereof.

According to one aspect of the invention, there is provided a inkjet recording device comprising: a plurality of inkjet heads each having an ink ejection surface in which a plurality of nozzles configured to eject ink drops are formed; a frame that has a plurality of holes formed therein and supports the plurality of inkjet heads such that the plurality of ink ejection surfaces are respectively exposed from the plurality of holes; a cap comprising a projection formed thereon to define a plurality of recessed portions each having a planar shape capable of encompassing each of the plurality of ink ejection surfaces which are exposed from the holes of the frame; and a cap moving mechanism configured to move at least one of the cap and the frame to selectively position the projection at a first position and a second position, wherein the projection at the first position abuts on the frame such that the plurality of ink ejection surfaces are respectively surrounded by the plurality of recessed portions, and wherein the projection at the second position is spaced from the frame.

DESCRIPTION

Hereinafter, an embodiment of the invention will be described with reference to the drawings.

Figure 1:
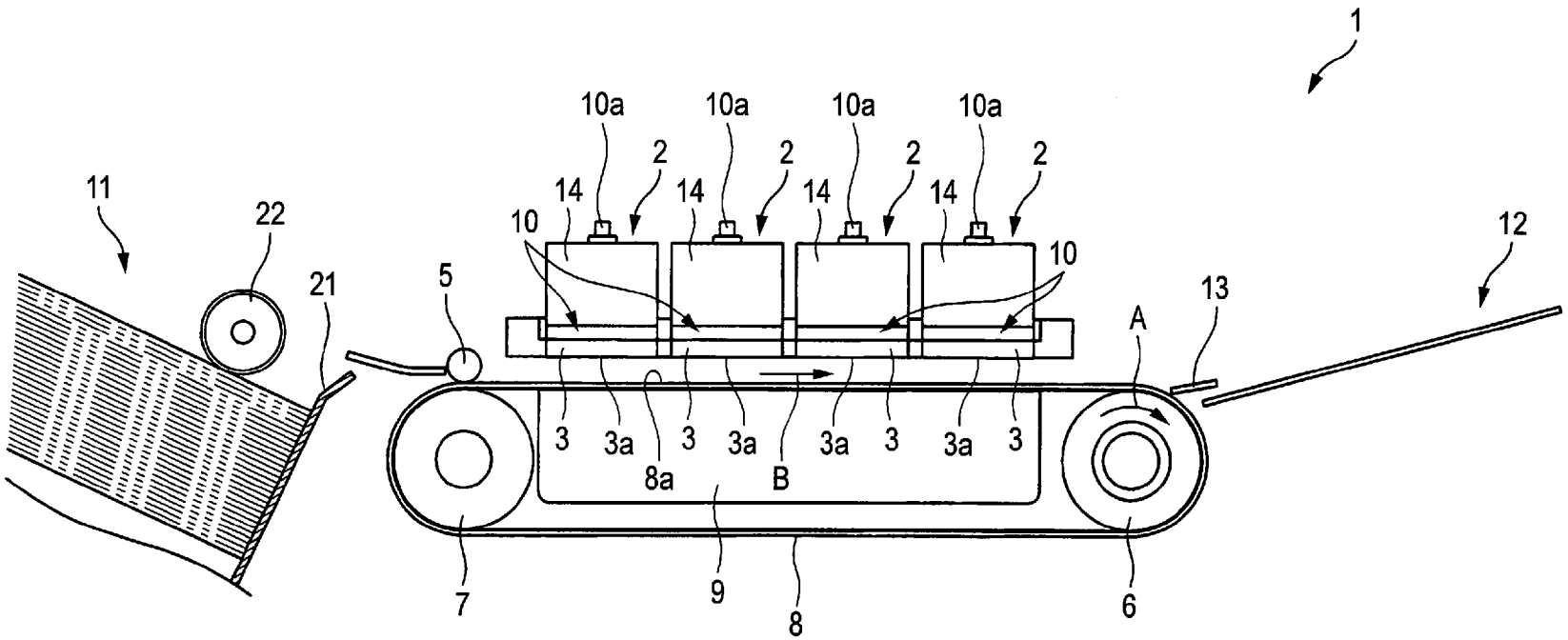
FIG. 1 is a schematic sectioned side view of an inkjet printer according to an embodiment of the invention.
Figure 2:
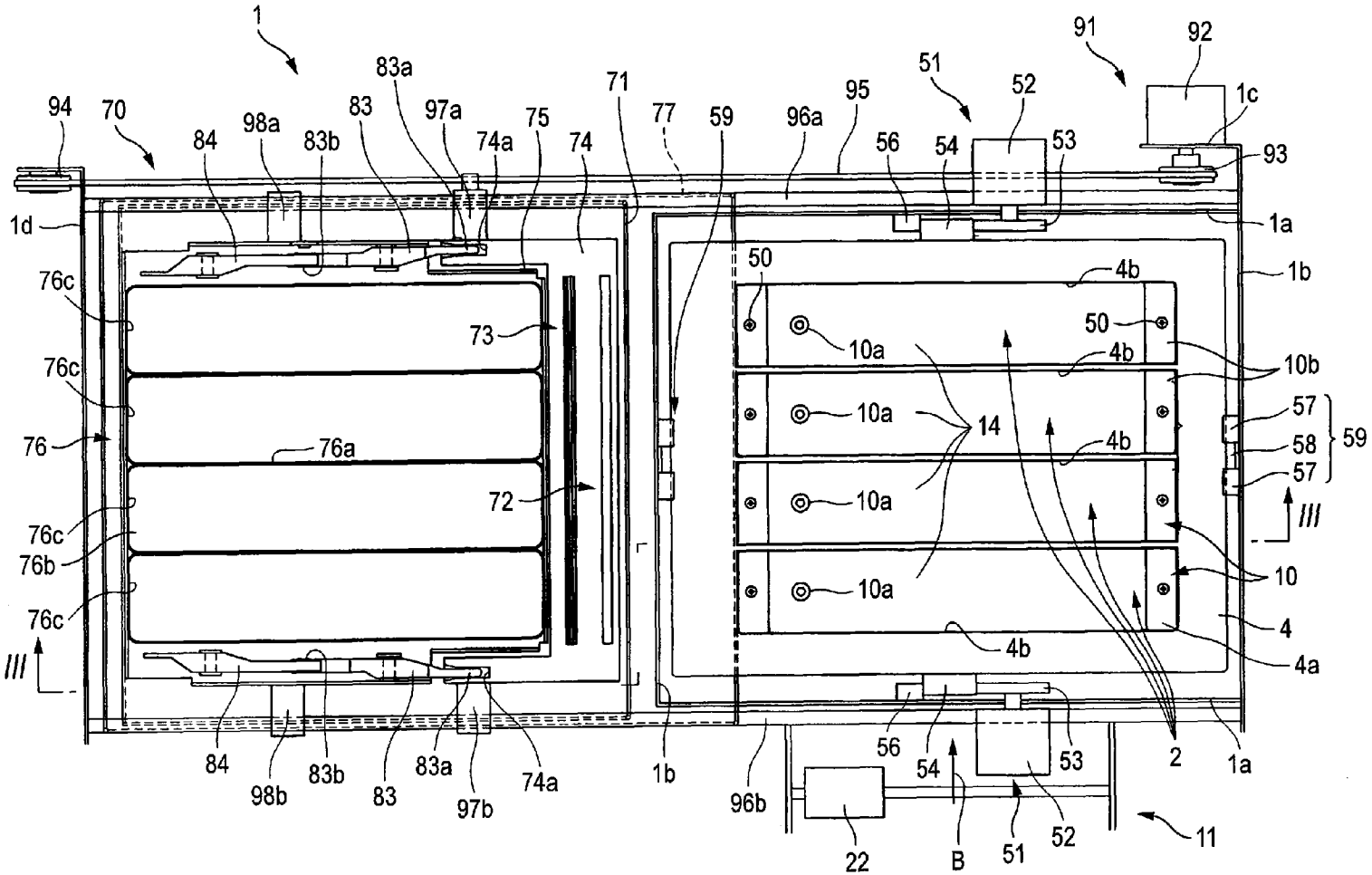
FIG. 2 is a schematic plan view of a main part of the inkjet printer shown in FIG. 1.
Figure 3:
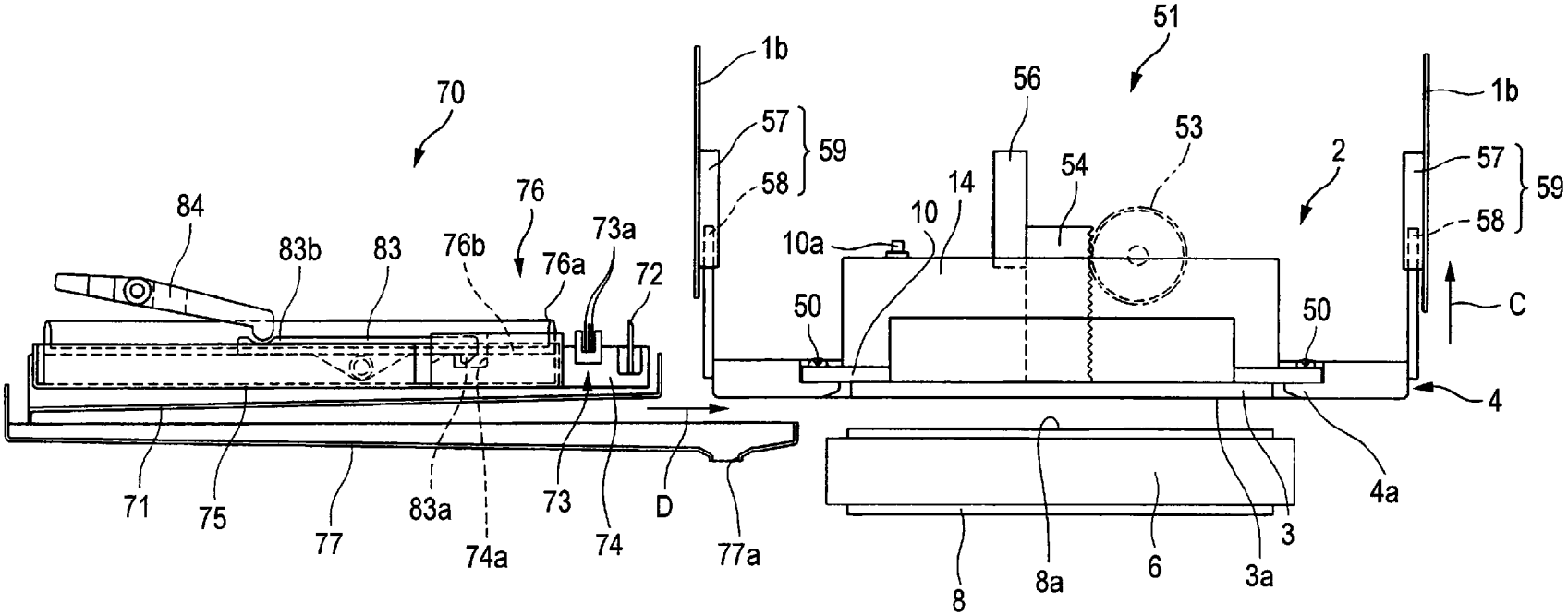
FIG. 3 is a sectional view taken along the line III-III shown in FIG. 2.
Figure 4:
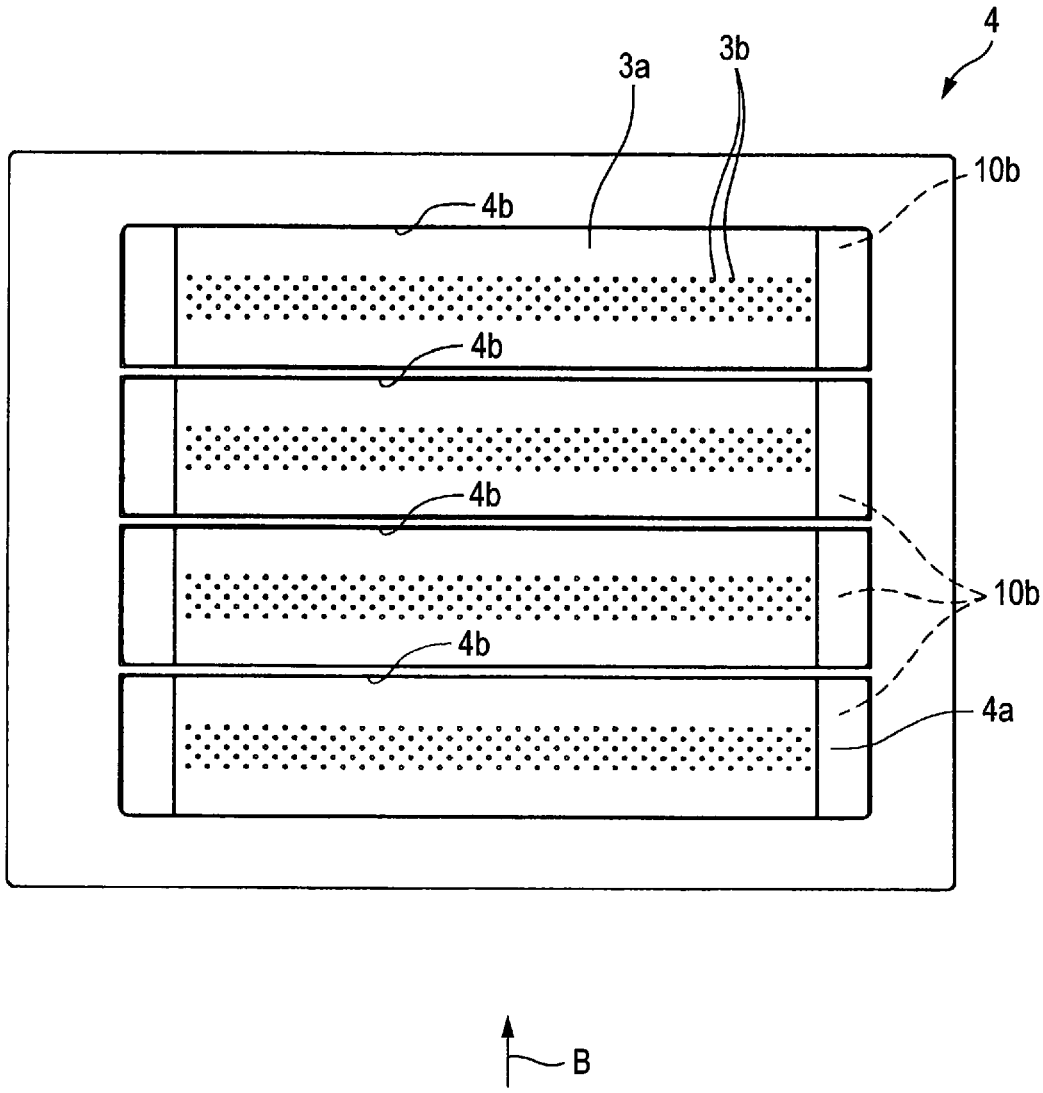
FIG. 4 shows four inkjet heads shown in FIG. 2 viewed from therebelow.

FIG. 1 is a schematic sectioned side view of an inkjet printer according to an embodiment of the invention. FIG. 2 is a schematic plan view of a main part of the inkjet printer according to the embodiment of the invention. FIG. 3 is a sectional view taken along the line III-III shown in FIG. 2. FIG. 4 shows four inkjet heads viewed from therebelow.

As shown in FIG. 1, an inkjet printer (a inkjet recording device) is configured as a color inkjet printer having four inkjet heads 2. This inkjet printer 1 includes a sheet feeding mechanism 11 provided at the left side in FIG. 1 and a sheet discharging tray 12 provided at the right side in FIG. 1.

The inkjet printer 1 includes therein a sheet conveying path on which a recording medium such as a sheet is conveyed from the sheet feeding mechanism 11 towards the sheet discharging tray 12. A pick-up roller is provided in the sheet feeding mechanism 11 configured to feed a top sheet of a plurality of sheets which are accommodated within a sheet tray 21. The sheet is fed from the left to the right as viewed in FIG. 1 by the pick-up roller 22. Two belt rollers 6, 7 and an endless conveying belt 8 that is wound around the rollers 6, 7 to extend therebetween are provided in a middle portion of the sheet conveying path. A silicone treatment is applied to an outer circumferential surface of the conveying belt 8, that is, a conveying surface 8*a* of the conveying belt 8 so as to impart adhesion to the conveying surface 8*a*. A pressing roller 5 is disposed directly down stream of the sheet feeding mechanism 11 in a position which faces the conveying belt 8 for pressing a sheet fed from the sheet feeding mechanism 11 against the conveying surface 8*a* of the conveying belt 8, whereby the sheet pressed against the conveying surface 8*a* is conveyed downstream while being held by virtue of the adhesion of the conveying surface 8*a*. At this time, a driving force by a drive motor (not shown) is applied to the belt roller 6 situated downstream in a sheet conveying direction to rotate clockwise (in a direction indicated by an arrow A) shown in FIG. 1.

In the middle portion of the sheet conveying path, an area facing the inkjet heads 2 corresponds to an image forming area where an image is formed on a sheet. Furthermore, a separation member 13 is provided directly downstream of the conveying belt 8 along the sheet conveying path. The separation member 13 is configured to separate a sheet held on the conveying surface 8*a* of the conveying belt 8 from the conveying surface 8*a* so that the separated sheet is conveyed towards the sheet discharging tray 12 disposed at the right.

A platen 9 having a substantially rectangular parallelepiped shape is disposed within an area surrounded by the conveying belt 8 at a position facing the inkjet heads 2, that is, disposed to contact with a lower surface of the conveying belt 8 positioned on upper side so as to support the conveying belt 8 from an inner circumferential side thereof.

The four inkjet heads 2 respectively correspond to inks of four colors B (magenta, yellow, cyan, black) and are aligned along the sheet conveying direction (a direction directed from bottom to top as viewed in FIG. 2). Namely, this inkjet printer is a line printer. As shown in FIG. 2, the inkjet head 2 has an elongated rectangular parallelepiped shape which extends in a direction perpendicular to the sheet conveying direction B. In addition, as shown in FIGS. 1 and 3, the inkjet head 2 includes a head main body 3 at a lower end thereof. The head main body 3 is a laminated body including a flow path unit and an actuator, the flow path unit includes an ink flow path containing a pressure chamber, and the actuator is configured to apply a pressure to ink stored in the pressure chamber.

A reservoir unit 10 configured to temporarily store ink is fixed to an upper surface of the head main body 3 and partially covered by a cover 14. The reservoir unit 10 is connected to a tube joint 10*a* fixed to an upper surface of the cover 14, and an ink reservoir configured to store ink supplied from the tube joint 10*a* is formed in the reservoir unit 10. As shown in FIG. 4, a large number of nozzles (ejection ports) 3*b* of a minute diameter are formed in lines on a bottom surface of the head main body 3 and aligned side by side, and this bottom surface corresponds to an ink ejection surface 3*a* which faces the conveying surface 8*a*. A repellent film, not shown, is formed on a surface of the ink ejection surface 3*a*. This repellent film prevents the adhesion of excess ink to the peripheries of the nozzles 3*b*. In addition, the reservoir unit 10 includes a head fixing portion 10*b* formed longer than the head main body 3 with respect to a direction perpendicular to the sheet conveying direction B. This head fixing portion 10*b* extends beyond longitudinal end portions of the head main body 3, and extended portions on both ends of the reservoir unit 10 correspond to fixing portions to the frame 4, which will be described later. In addition, ink inside the reservoir unit 10 is to be supplied into the ink flow path (not shown) in the head main body 3.

The head main body 3 is disposed such that the ink ejection surface 3*a* becomes parallel to the conveying surface 8*a* of the conveying belt 8 with a small clearance formed between these surfaces. In this configuration, when a sheet conveyed on the conveying belt 8 passes below the four head main bodies 3 sequentially, inks of the four colors are ejected from the nozzles 3*b* towards an upper surface or a printing surface of the sheet to thereby form a color image on the sheet.

The four inkjet heads 2 are fixed to the frame 4. As shown in FIGS. 2 and 4, four rectangular holes 4*b* are formed in the frame 4 to extend in a direction perpendicular to the sheet conveying direction B. The four holes 4*b* are disposed adjacent to one another along the sheet conveying direction B, and the inkjet heads 2 are disposed in correspondence with the holes 4*b*, respectively. As shown in FIGS. 3 and 4, support portions (support areas) 4*a* are formed in each hole 4*b* and project to positions which face lower surfaces of the longitudinal end portions of the reservoir unit 10, respectively. The support portions 4*a* and the end portions of the reservoir unit 10 are fixed to each other with screws 50. Namely, the support portions 4*a* constitute areas which are closer to the hole 4*b* than an outer circumferential frame (an abutment area) of each hole 4*b* of the frame 4 and where a part of the inkjet head 2 overlaps with the frame 4 in plan view. Note that the thickness of the outer circumferential frame of each hole 4*b* of the frame 4 is thicker than the thickness of the support portion 4*a*. In this way, the four inkjet heads 2 are disposed and fixed in correspondence with the holes 4*b* of the frame 4, respectively. The ink ejection surfaces 3*a* of the inkjet heads 2 are exposed from openings at one side of the holes 4*b* one by one. The ink ejection surfaces 3*a* and lower surfaces of the outer circumferential frames are disposed substantially at the same height. In addition, a sealing material (not shown) is applied to a boundary between the inkjet heads 2 and the frame 4 seal the boundary.

As shown in FIGS. 2 and 3, the frame 4 is movably supported in a vertical direction by frame moving mechanisms (cap moving mechanisms) 51 which are provided in the inkjet printer 1. As shown in FIG. 2, the frame moving mechanisms 51 are provided outside of (above and below) the four inkjet heads 2 arranged as described above. Each of the frame moving mechanism 51 includes: a drive motor 52 serving as a drive source configured to move the frame 4 vertically; a pinion gear 53 fixed to a shaft of the drive motor 52; a rack gear 54 provided on the frame 4 and erects therefrom to mesh with the pinion gear 53; and a guide 56 disposed at a position where the guide 56 and the pinion gear 53 sandwiche the rack gear 54.

The two drive motors 52 are respectively fixed to main body frames la of the inkjet printer 1, and the main body frames la are disposed to face each other with respect to the sheet conveying direction B. The two rack gears 54 extend vertically and are fixed respectively to sides of the frame 4 at lower end portions thereof. In addition, a side of the rack gear 54 which is opposite to a side facing the pinion gear 53 sliding-contacts with the guide 56. The guide 56 is fixed to the main body frame 1*a*.

In this configuration, when the two drive motors 52 are synchronized to rotate the corresponding pinion gears 53 clockwise and counterclockwise, the rack gears 54 move vertically. Then, the frame 4 and the four inkjet heads 2 move vertically in association with the vertical movement of the rack gears 54.

Guide units 59 are provided to face the longitudinal ends of the inkjet heads 2. Each of the guide units 50 includes a rod-shaped member 58 and a pair of guides 57 which hold the rod-shaped member 58 therebetween. The pair of guides 57 extend vertically as shown in FIG. 3 and are fixed to each of main body frames 1*b* which face each other with respect to the direction perpendicular to the sheet conveying direction B. The rod-shaped member 58 extends vertically similar to the pairs of guides 57 and is fixed to a side surface of the frame 4 facing in parallel with the main body frame 1*b*. The rod-shaped member 58 is slidably held between the pair of guides 57. When the frame 4 is moved vertically by the frame moving mechanisms 51, these guide units 59 can prevent the inclination of the ink ejection surfaces 3*a* of the inkjet heads 2 towards the conveying surface 8*a*. Namely, even though the frame 4 and the inkjet heads 2 are moved vertically by the frame moving mechanisms 51, the ink ejection surfaces 3*a* are always kept parallel to the conveying surface 8*a*. As a result, the dropping accuracy of inks relative to a sheet is increased during printing.

Normally, the frame 4 is disposed at a printing position (a position shown in FIG. 3), and the four inkjet heads 2 eject inks on a sheet for printing when the frame 4 is positioned at the printing position in addition, only when the maintenance operation is performed on the inkjet heads 2, the frame 4 is moved by the frame moving mechanisms 51 so that the four inkjet heads 2 are moved to a higher position (a head maintenance position) than the printing position. In this embodiment, the maintenance operation includes: purging the inkjet heads 2 of inks forcibly; wiping off inks adhering to the ink ejection surfaces 3*a*; and covering the ink ejection surfaces 3*a* with a cap.

Next, a maintenance unit 70 used for the maintenance operation performed on the inkjet heads 2 will be described. As shown in FIGS. 2 and 3, the maintenance unit 70 is disposed on the inkjet printer 1 to the left of the inkjet heads 2 for performing maintenance work on the head main bodies 3. As shown in FIG. 3, the maintenance unit 70 includes two trays 71, 75 that are horizontally movable. As shown in FIGS. 2 and 3, the tray 71 has a substantially square box shape opened upwards and is configured to encompass the tray 75 therein. The tray 71 and the tray 75 are detachably joined together by engagement devices, which will be described. The trays 71, 75 are adapted to be attached and detached according to the details of the maintenance operation to be performed.

As shown in FIG. 3, the tray 71 is opened on an opposite side to a side facing to the inkjet heads 2. Accordingly, when the two trays are disengaged from each other in order to perform, e.g., a purging operation, only the tray 71 is movable independent of the tray 75. In addition, irrespective of the fact that the engagement devices keep the engagement of the two trays 71, 75, when the maintenance unit 70 moves horizontally as will be described later, the frame 4 is moved to the upper head maintenance position (in a direction indicated by an arrow C in FIG. 3) in advance, whereby a space for the maintenance unit 70 is secured between the four inkjet heads 2 and the conveying surface 8*a*. Thereafter, the maintenance unit 70 is moved horizontally in a direction indicated by an arrow D in FIG. 3.

Thereafter, a waste ink receiving tray 77 is disposed immediately below the maintenance unit 70. The waste ink receiving tray 77 has a size to house the tray 71 therein in plan view. Also, the waste ink receiving tray 77 has a shape so that, even when the tray 71 is moved to a right end shown in FIG. 2, the waste ink receiving tray 77 overlap, in plan view, with an edge portion of the tray 71 (left side in FIG. 2) opposite to an edge facing the inkjet heads 2 (right side in FIG. 2). An ink discharge hole 77*a* is formed in an end portion of the inkjet heads 2 side of the waste ink receiving tray 77 to penetrate through the ink receiving tray 77. The waste ink discharge hole 77*a* allows ink having flowed into the waste ink receiving tray 77 to flow into a waste ink reservoir (not shown).

A wiper 72, an ink receiving member 73 and the tray 75 are disposed in the tray 71 in this order from the inkjet heads 2 side thereof. Any of them is disposed substantially parallel to the sheet conveying direction B. As shown in FIG. 2, a cap 76 is disposed within the tray 75. The cap 76 includes projection 76*a* and four bottom plate portions 76*b*. In the cap 76, the four bottom plate portions 76*b* each having a rectangular shape in plan view are disposed side by side in correspondence with the ink ejection surfaces 3*a* of the inkjet heads 2, respectively. The longitudinal direction of the bottom plate portions 76 is parallel to the longitudinal direction of the inkjet heads 2, and the bottom plate portions 76 are arranged along the sheet conveying direction B at the same intervals as the inkjet heads 2.

The projection 76*a* projects upwards from outer circumferential edge portions of the bottom plate portions 76*b*, whereby the projection 76*a* and the bottom plate portions 76*b* are integrated with each other to define four recessed portions 76*c* opened upwards. Each of the four recessed portions 76*c* has a shape capable of encompass the ink ejection surface 3*a* in plan view. The projection 76*a* abuts on only outer circumferential edge portions of the holes 4*b* in the frame 4 when a capping operation is performed as will be described later. At this time, each of the four ink ejection surfaces 3*a* is surrounded by the portion 76*c* (see FIG. 6). In this way, the cap 76 can cover the ink ejection surfaces 3*a*, so that the cap 76 can receive inks resulting from the purging of the nozzles 3*b* and also prevent inks in the nozzles from being dried. The cap 76 is made of an elastic material such as rubber. Due to this, the adhesion between the frame 4 and the projection 76*a* is facilitated, and when the projection 76*a* abuts on the frame 4, the airtightness of each recessed portion 76*c* can be held.

The cap 76 is urged upwards by an elastic member such as springs 88 (see FIG. 5B) while being supported on a bottom surface of the tray 75. By this configuration, when the projection 76*a* of the cap 76 abuts on the frame 4, the springs 88 dampen impact and hold the frame 4 and the cap 76 via the projection 76*a*. Even though the cap 76 is not slightly parallel to the frame 4 in error, the cap 76 is allowed to follow inclination relative to the frame 4. Due to this, the inside of each recessed portion 76 can be made into a closed space.

As shown in FIG. 2, a holding member 74 is fixed to the side of the tray 71 which faces the inkjet heads 2. The holding member 74 holds the wiper 72 and the ink receiving member 73. As shown in FIG. 2, the holding member 74 has a U-shape in plan view, and the wiper 72 and the ink receiving member 73 are held to a portion of the holding member 74 which extends along the sheet conveying direction B. On the other hand, recessed portions 74*a* forming a part of the engagement devices are formed in ends of portions of the holding member 74 which extend in the direction perpendicular to the sheet conveying direction B.

As shown in FIGS. 2 and 3, the ink receiving member 73 includes a plurality of thin plates 73*a* which are slightly longer in a direction along the conveying direction B than the overall width of the four inkjet heads 2 which are aligned side by side. The thin plates 73*a* are disposed parallel to each other at intervals suitable for a capillary force relative to ink. The thin plates 73*a* are made of stainless steel. As with the thin plates 73*a*, the wiper 72 is slightly longer in a direction along the conveying direction B than the overall width of the four inkjet heads which are aligned side by side and is disposed such that the length direction thereof becomes parallel to the sheet conveying direction B. The wiper 72 is made of an elastic material such as rubber.

The tray 71 engages with the tray 75 by means of the engagement devices as described above. As shown in FIG. 2, the engagement devices are installed in the vicinity of upper and lower sides of the trays 71, 75 in FIG. 2, respectively. Each of the engagement devices includes the recessed portion 74*a* provided at the holding member 74 of the tray 71 and a hook member 83 rotatably supported on the tray 75. The hook member 83 extends in the direction perpendicular to the sheet conveying direction B and is rotatably supported at a longitudinal center thereof. A hook portion 83*a* is formed at an end portion of the hook member 83 which faces the inkjet heads 2 and configured to engage with the recessed portion 74*a*. Abutment members 84 are rotatably supported above the maintenance unit 70 and configured to abut on end portions 83*b* of the hook members 83 which are spaced farthest from the inkjet heads 2, respectively. When these abutment members 84 rotate and respectively abut on the end portions 83*b*, the engagement between the hook members 83 and the recessed portions 74*a* is released. On the other hand, when the abutment members 84 move away from the end portions 83*b*, the hook portions 83*a* engage with the recessed portion 74*a*, and a state shown in FIG. 3 is restored.

When the maintenance operation (described later) is not performed, the maintenance unit 70 stays at rest in a "retracted position" (a left-hand position which is opposite to the inkjet heads 2 side in FIG. 2) which is spaced away from the inkjet heads 2. Then, when the maintenance operation is performed, the maintenance unit 70 is moved horizontally from this retracted position to a "maintenance position" to face the ink ejection surfaces 3*a* of the inkjet heads 2. At this time, the inkjet heads 2 are disposed in the head maintenance position, thereby the wiper 72 and a distal end of the projection 76*a* do not contact with the ink ejection surfaces 3*a*. Furthermore, it is designed to have a slight clearance (for example, 0.5 mm) between the ink receiving member 73 and the ink ejection surfaces 3*a* at all times in a state where the wiper 72 is in abutment with the ink ejection surfaces 3*a*.

When the ink ejection surfaces 3*a* are covered by the cap 76, the tray 71 and the tray 75 are moved to the maintenance position while being joined together by the engagement devices. As shown in FIG. 2, the trays 71, 75 are movably supported on a pair of guide shafts 96*a*, 96*b* which extend in the direction perpendicular to the sheet conveying direction B. Two bearing members 97*a*, 97*b* are provided on the tray 71 and project from the upper and lower sides of the holding member 74 in FIG. 2. Two bearing members 98*a*, 98*b* are provided on the tray 75 and project from upper and lower sides of the tray 75 in FIG. 2. In addition, both ends of each of the pair of guide shafts 96*a*, 96*b* are respectively fixed to the main body frames 1*b*, 1*d*, and the guide shafts 96*a*, 96*b* are disposed in parallel between the main body frames 1*b*, 1*d*. The guide shafts 96*a*, 96*b* are fixed with fixing members such as screws. According to this configuration, the trays 71, 75 are moved horizontally (in the direction indicated by the arrow D) in FIGS. 2 and 3 along the guide shafts 96*a*, 96*b*.

Here, a horizontal moving mechanism 91 configured to horizontally move the trays 71, 75 will be described. As shown in FIG. 2, the horizontal moving mechanism 91 includes a motor 92, a motor pulley 93, an idle pulley 94, a timing belt 95 and the guide shafts 96*a*, 96*b*. The motor 92 is fixed with a fixing member such as a screw to a mounting portion 1*c* that is formed at an end portion of the main body frame 1*b* extending parallel to the sheet conveying direction B. The motor pulley 93 is connected to the motor 92 and rotates in association with the drive of the motor 92. The idle pulley 94 is rotatably supported on the main body frame 1*d* which is situated most leftwards in FIG. 2. The timing belt 95 is provided parallel to the guide shaft 96*a* and is wound around and extends between the motor pulley 93 and the idle pulley 94 paired with the motor pulley 93. In addition, the bearing member 97*a* provided on the holding member 74 is connected to the timing belt 95.

In this configuration, when the motor 92 is driven, the timing belt 95 runs as the motor pulley 93 rotates forwards or backwards. The tray 71, which is connected to the timing belt 95 via the bearing member 97*a*, is moved to the left or the right in FIG. 2, that is, to the retracted position or the maintenance position by virtue of the running of the timing belt 95. In addition, when the recessed portions 74*a* of the holding member 74 engages with the hook portions 83*a*, the wiper 72 and the ink receiving member 73 disposed in the tray 71 and the cap 76 disposed in the tray 75 move together to the maintenance position or the retracted position.

Figure 5A:
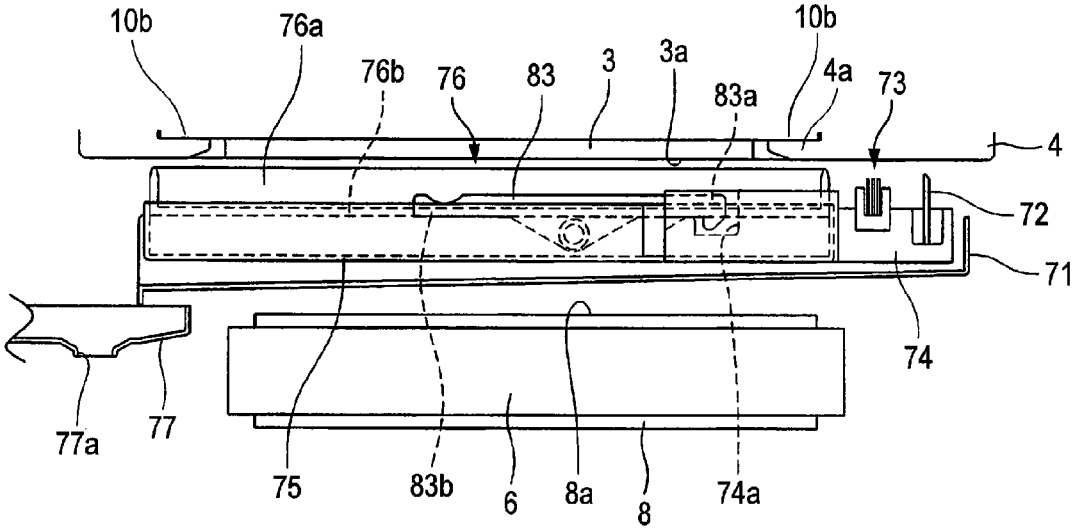
FIG. 5A shows a state where the whole of a maintenance unit shown in FIG. 2 is moved to a maintenance position.
Figure 5B:
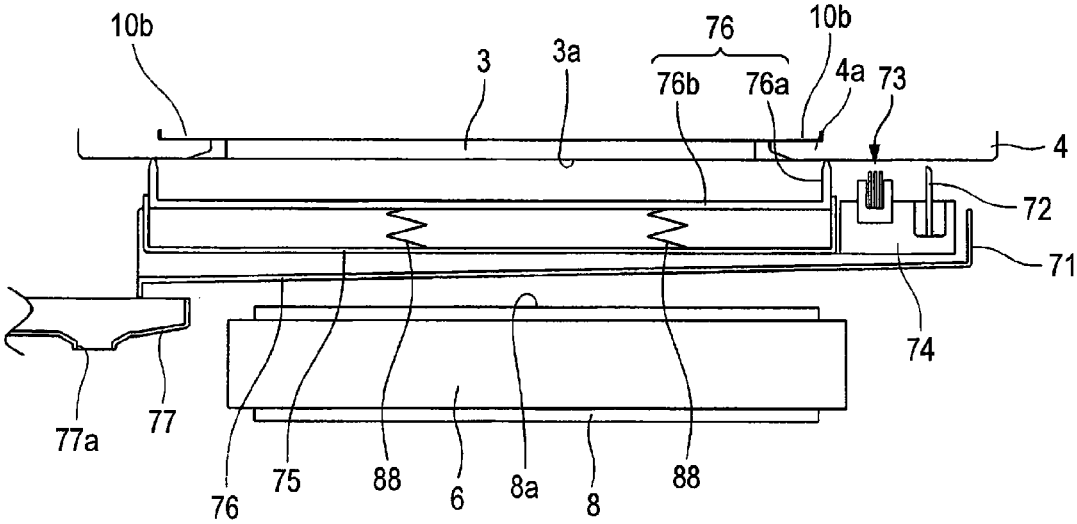
FIG. 5B shows a state where projection of a cap shown in FIG. 2 abuts on a frame.
Figure 6:
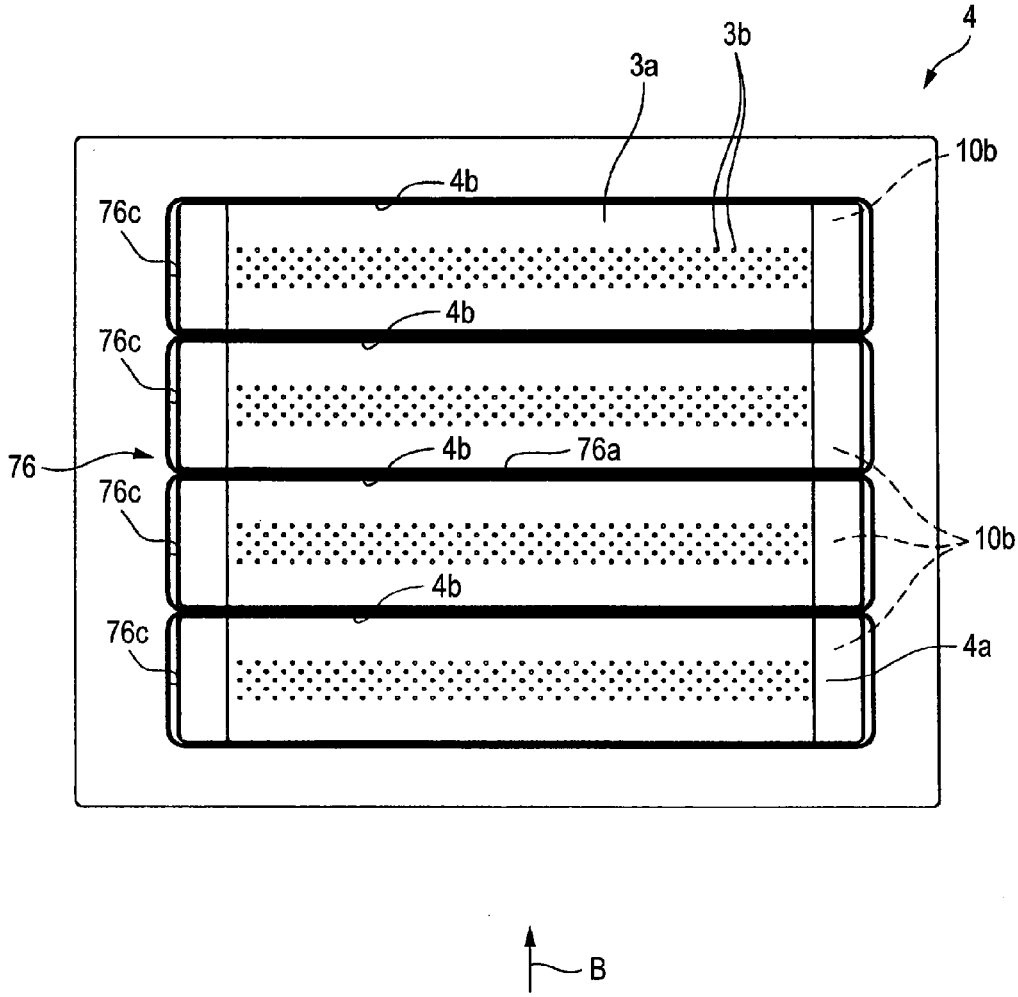
FIG. 6 is a plan view showing a positional relationship between the inkjet heads and the projection when the projection of the cap shown in FIG. 2 abut on the frame.
Figure 7A:
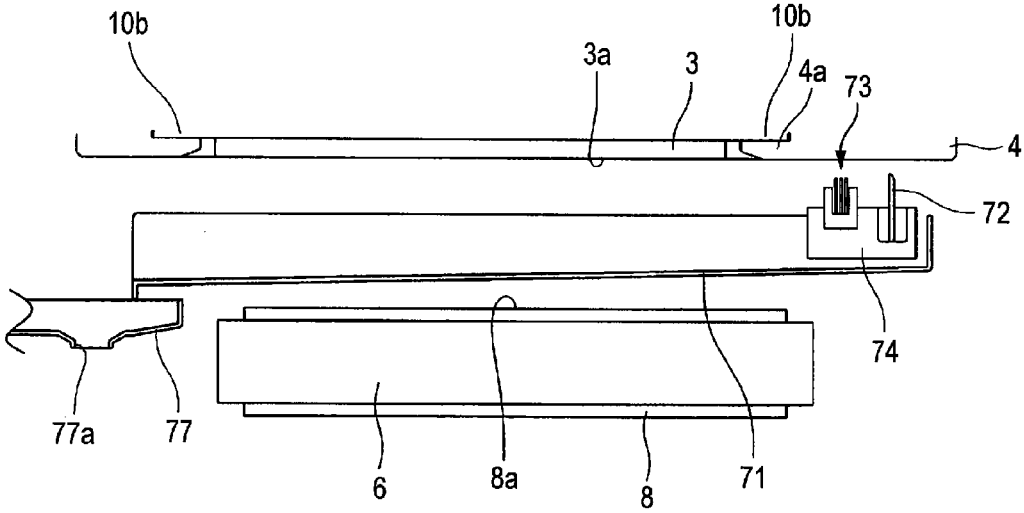
FIG. 7A shows a state where the inkjet heads are moved from a printing position to a head maintenance position and a tray of the maintenance unit moves to the maintenance position.
Figure 7B:
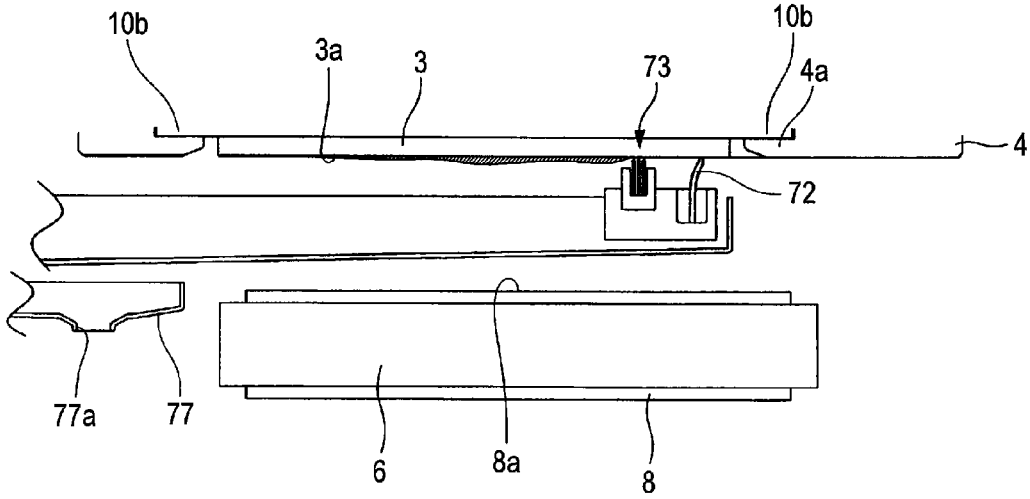
FIG. 7B shows a state where inks adhering to the ink ejection surfaces are wiped off by an ink receiving member and a wiper.

Next, the operation of the maintenance unit 70 will be described below with reference to FIGS. 5A to 7B. FIG. 5A shows a state where the whole of the maintenance unit 70 moves to the maintenance position, and FIG. 5B shows a state where the projection 76*a* of the cap 76 contacts with the ink ejection surfaces 3*a*. FIG. 6 is a plan view showing a positional relationship between the inkjet heads 2 and the projection 76*a* when the projection 76*a* of the cap 76 abuts on the frame 4. FIG. 7A shows a state where the inkjet heads 2 are moved from the printing position to the head maintenance position and the tray 71 of the maintenance unit 70 moves to the maintenance position, and FIG. 7B shows a state where inks adhering to the ink ejection surfaces 3*a* are wiped off by the ink receiving member 73 and the wiper 72.

When a purging operation is performed for restoring the inkjet heads 2 which are experiencing an ejection failure to the normal condition, firstly, the frame 4 is moved upwards by the frame moving mechanisms 51. At this time, the two drive motors 52 are synchronously driven to allow the respective pinion gears 53 to rotate in a forward direction (a clockwise direction as viewed in FIG. 3). Then, the rack gears 54 move upwards in conjunction with the rotation of the pinion gears 53. The frame 4 fixed to the rack gears 54 is moved upwards together with the four inkjet heads 2. In addition, the drive motors 52 stop rotating when the frame 4 and the inkjet heads 2 arrive at the maintenance position. Thus, a space capable of disposing the maintenance unit 70 is formed between the ink ejection surfaces 3*a* and the conveying belt 8. In this way, when the maintenance unit 70 has moved to the maintenance position, the inkjet heads 2 and the ink ejection surfaces 3*a* which are located at the maintenance position do not contact with the wiper 72 and the distal end of the projection 76.

Then, a capping operation is performed for covering the ink ejection surfaces 3*a* with the cap 76. Note that this capping operation is performed to prevent inks in the nozzles 3*b* being dried during an idle time during which the inkjet printer 1 performs no printing operation on sheets for a long period of time. As shown in FIG. 5A, in the capping operation, the tray 71 and the tray 75 are moved to the maintenance position by the horizontal moving mechanism 91 in a state that the tray 71 and the tray 75 are joined to each other by the hook members 83. At this time, as shown in FIG. 6, the projection 76*a* of the cap 76 is disposed in positions where the projection 76*a* faces the circumferential edge portions of the respective holes 4*b*. At this time, the recessed portions 76*c* of the cap 76 are disposed in position where the recessed portions 76*c* face the corresponding ink ejection surfaces 3*a*.

Next, as shown in FIG. 5B, an upper end of the projection 76*a* abuts on the frame 4 by moving the inkjet heads 2 downwards by the frame moving mechanisms 51, whereby the cap 76 is attached to the four inkjet heads 2, and the ink ejection surfaces 3*a* are surrounded individually by the corresponding recessed portions 76*c*. At this time, since the projection 76*a* does not contact with ink ejection surfaces 3*a* as described above, deposits is not produced on the ink ejection surfaces 3*a* caused by the chemical reaction of inks remaining on the ink ejection surfaces 3*a* with the elastic material of the cap 76. In addition, ink is not accumulated in the boundary between the projection 76*a* and the ink ejection surfaces 3*a*, which prevents dust scattering around the boundary from adhering to accumulated ink which causes a production of a sticking substance. Consequently, even when the cap 76 is moved apart from the inkjet heads 2, impurities such as deposits and sticking substances do not adhere to the ink ejection surfaces 3*a*.

A purging operation is performed in a state that the cap 76 is attached to the four inkjet heads 2, and pumps (all not shown) are driven to forcibly send inks in the ink tanks to the inkjet heads 2 to eject inks from the nozzles 3*b* of the inkjet heads 2 into the recessed portions 76*c*. At this time, although ink is allowed to scatter within each recessed portion 76*c*, scattered ink does not leak outwards from the recessed portion 76*c*. Therefore, the scattered ink does not adhere to the other ink ejection surfaces 3*a*. This purging operation can eliminate the clogging of the nozzles 3*b* which causes the ejection failure or the increase in viscosity of inks within the nozzles 3*b*. Inks ejected to the recessed portions 76*c* flow into the tray 71 via a discharge flow path (not shown) and then move to leftwards in FIGS. 5A and 5B along the bottom surface of the tray 71 and finally flows into the waste ink receiving tray 77. Then, the purged inks are discharged from the discharge hole 77*a* in the waste ink receiving tray 77. However, a part of the inks remains on the ink ejection surfaces 3*a* in the form of ink drops.

Next, a wiping operation is performed. When a wiping operation is performed, as shown in FIG. 7A, only the tray 71 may move to the maintenance position. In this case, the abutment members 84 abut on the end portions 83*b* of the hook members 83 to move the hook portions 83*a* away from the recessed portions 74*a*, so that the engagements between the recessed portions 74*a* and the hook portions 83*a* are released, whereby the connection between the tray 71 and the tray 75 is released. Thereafter, the wiping operation may be started.

In the wiping operation, the inkjet heads 2 are moved downwards by the frame moving mechanisms 51 in a state where at least the tray 71 is moved to the maintenance position. At this time, the inkjet heads 2 are disposed in a position where for example, a clearance of 0.5 mm is formed between the ink ejection surfaces 3*a* and the upper ends of the thin plates 73*a* of the ink receiving member 73 when the tray 71 is moved to the left (that is, to the retracted position). Then, as shown in FIG. 7B, the tray 71 is moved to the left by the horizontal moving mechanism 91.

At this time, since an upper end of the wiper 72 is positioned higher than the ink ejection surfaces, the wiper 72 contacts with the ink ejection surfaces 3*a* while being deflected, so as to wipe off inks adhering to the ink ejection surfaces 3*a* as a result of the purging operation. At this time, the upper ends of the thin plates 73*a* of the ink receiving member 73 are positioned close to but without contacting with the ink ejection surfaces 3*a* via the predetermined minute gap, whereby relatively large ink drops of the inks adhering to the ink ejection surfaces 3*a* are moved in between the thin plates 73*a* of the ink receiving member 73 by virtue of capillarity.

In this way, the maintenance operation is completed for restoring the inkjet heads 2 with the ink ejection failure to the normal conditions by purging the nozzles 3*b* of ink and for wiping off inks adhering to the ink ejection surfaces 3*a* as a result of purging. As described above, after the maintenance operation has been completed, the capping operation is preferably performed again to cover the ink ejection surfaces 3*a* with the cap 76, which can prevent the drying of inks in the nozzles 3*b*.

According to the inkjet printer 1 of the embodiment, the ink ejection surfaces 3*a* of the inkjet heads 2 are surrounded by the recessed portions 76*c* of the cap 76 when the cap 76 is attached to the inkjet heads 2. Therefore, even though inks purged of from the nozzles 3*b* scatter within the recessed portions 76*c*, the scattered inks do not adhere to the ink ejection surfaces 3*a* of other inkjet heads 2, whereby the plurality of kinds of inks do not mix on the ink ejection surfaces 3*a*, which can prevent the deterioration of printing quality. In addition, since the recessed portions 76*c* of the cap 76 abut on only with the frame 4, the adhesion of impurities to the ink ejection surfaces 3*a* can be suppressed. Therefore, even though the ink ejection surfaces 3*a* are wiped by the wiping operation, it is possible to suppress the adhesion of the impurities to the peripheries of the nozzles which causes the deterioration of the repellency of the ink ejection surfaces 3*a* or to suppress the intrusion of the impurities into the nozzles which becomes the clogs of the nozzles.

In addition, since the sealing material is applied to the boundary between the inkjet heads 2 and the frame 4 to seal the boundary, it becomes possible to prevent the intrusion of inks, which scatters around as a result of purging, into the inkjet printer 1 from the gap between the holes 4*b* of the frame 4.

Furthermore, since the thickness of the outer circumferential frames of the respective holes 4*b* of the frame 4 is thicker than the support portions 4*a*, the strength of the outer circumferential frames of the respective holes 4*b* of the frame 4 is increased. Therefore, the projection 76*a* can reliably abut on the outer circumferential frames of the respective holes 4*b*.

The embodiment of the invention has been described above. However, the invention is not limited to the embodiment but can be modified variously without departing from the spirit and scope of the invention. For example, although the ink ejection surfaces 3*a* and the lower surface of the frame 4 are disposed within the same plane in the embodiment, the ink ejection surfaces 3*a* may project from the lower surface of the frame 4. According to this configuration, the ink ejection surfaces 3*a* are spaced from the lower surface of the frame 4, thereby the wiper 72 does not wipe the lower surface of the frame 4 when the wiping operation is performed. Due to this, even though impurities adhere to the lower surface of the frame 4, it can reliably prevent the adhesion of impurities or foreign matters to the nozzles or the peripheries thereof.

Although the inkjet printer 1 of the embodiment includes the four inkjet heads 2, the number of the inkjet heads 2 may be two or three, or five or more.

Furthermore, although the sealing material of the embodiment is applied to the boundary between the inkjet heads 2 and the frame 4, no sealing material may be applied, which easily prevents the break of menisci at the nozzles due to a pressure change outside the cap 76.

Although the thickness of the outer circumferential frames of the respective holes 4*b* in the frame 4 is thicker than the thickness of the support portions 4*a* according to the embodiment, the thickness of the frame may be determined arbitrarily.

In the embodiments, the cap 76 may be disposed individually for each inkjet head 2 or may be integrally molded so as to encompass each of the ink ejection surfaces 3*a* of all the inkjet heads 2.

What is claimed is:

1. A inkjet recording device comprising:

a plurality of inkjet heads each having an ink ejection surface in which a plurality of nozzles configured to eject ink drops are formed;

a frame that has a plurality of holes formed therein and supports the plurality of inkjet heads such that the plurality of ink ejection surfaces are respectively exposed from the plurality of holes, the frame comprising:

an abutment area and a support area which is positioned closer to the holes than the abutment area and overlaps with a part of each of the inkjet heads in plan view, and a cap comprising a projection formed thereon to define a plurality of recessed portions each having a planar shape capable of encompassing each of the plurality of ink ejection surfaces which are exposed from the holes of the frame; and a cap moving mechanism configured to move at least one of the cap and the frame to selectively position the projection at a first position and a second position, wherein at the first position, the projection abuts the abutment area of the frame, wherein the projection at the first position abuts on the frame such that the plurality of ink ejection surfaces are respectively surrounded by the plurality of recessed portions, a thickness of the abutment area is thicker than a thickness of the support area, the inkjet heads being supported on the support area, and the projection at the second position is spaced from the frame.

2. The inkjet recording device according to claim 1, wherein a sealing material is applied to a boundary between the inkjet heads and the frame to seal the boundary.

3. The inkjet recording device according to claim 1, wherein the abutment area is positioned outside an area overlapping with the inkjet heads in plan view.

4. The inkjet recording device according to claim 1, further comprising an elastic member configured to urge the cap toward the ink ejection surface.

5. The inkjet recording device according to claim 1, wherein the inkjet heads are adapted to eject inks of different colors.

* * * * *